United States Patent [19]

McMullen

[11] 4,141,182

[45] Feb. 27, 1979

[54] CORROSION PROOF SNOW GUARD

[76] Inventor: John R. McMullen, 1500 State St., Camp Hill, Pa. 17011

[21] Appl. No.: 874,597

[22] Filed: Feb. 2, 1978

[51] Int. Cl.[2] ..... E04D 13/00

[52] U.S. Cl. ..... 52/24

[58] Field of Search ..... 52/24–26; D8/499

[56] References Cited

U.S. PATENT DOCUMENTS

| | | | |
|---|---|---|---|
| 507,776 | 10/1893 | Berger et al. | 52/24 |
| 860,457 | 7/1907 | Frank | 52/24 |
| 1,095,822 | 5/1914 | Danzer | 52/25 |
| 1,463,065 | 7/1923 | Sieger | 52/24 |

*Primary Examiner*—J. Karl Bell

*Attorney, Agent, or Firm*—Sughrue, Rothwell, Mion, Zinn and Macpeak

[57] ABSTRACT

A roof snow guard in the form of a flat base member mounted flush to an inclined building roof and extending parallel thereto in the direction of incline and having a wing member extending angularly outwardly of the base member at the lower end thereof to prevent movement of snow or ice on the roof, which is formed integrally with the base member of molded clear plastic to render the snow guard practically invisible on the roof, reduce cost, and prevent discoloration of the roof during weathering of the snow guard since it is immune to corrosion.

3 Claims, 3 Drawing Figures

CORROSION PROOF SNOW GUARD

FIELD OF THE INVENTION

The present invention is directed to snow guards for sloped or inclined roofs, and more particularly, to an improved snow guard which is rendered essentially invisible and which is corrosion proof.

BACKGROUND OF THE INVENTION

Snow guards have long been employed for fixed mounting to the lower ends of inclined building roofs, particularly in areas of the roof carrying gutters or other water collecting systems and above such gutters or water collecting systems to prevent the movement of snow or ice that accumulates on roofs and minimizing the possibility of damage to the gutters or water collection systems. Presently, such snow guards are formed of cast metal such as iron or fabricated from sheet metal such as steel. The metal snow guards are sometimes coated for resistance to corrosion. All of the presently known snow guards are to some degree responsible for marking or streaking of the roof surfaces due to their corrosion during weathering over an extended time period, such corrosion being inherent in the cast metal or fabricated metal portions, particularly the metal base.

Attempts have been made to form the snow guards of cast aluminum to prevent streaking as result of corrosion of the fabricated metal devices, but even those of cast aluminum result in streaking of the roof below the snow guard, since the aluminum as a result of its anodizing, produces a darkening stain which, although distinct from the red rust condition normally attributed to cast metal snow guards such as cast iron or fabricated steel, is readily visible. Thus, regardless of whether the snow guard is formed of unitary cast construction or wholly or partially of fabricated metal or whether the cast metal comprises iron or aluminum, there is always some discoloration to the roof due to corrosion or anodizing of the known snow guards.

Further, since snow guards are essentially located at prominent portions of the roof and easily seen from the ground, the snow guards formed of opaque material such as cast iron, cast aluminum or fabricated metal, are distinct in appearance, and are essentially unattractive, leading to the distraction of the roof from its normal architectural esthetics.

Further, snow guards whether cast unitarily or partially fabricated from metal, are relatively expensive in terms of their manufacture.

SUMMARY OF THE INVENTION

The present invention is directed to an improved snow guard of the type comprising a flat base member for mounting flush with an inclined building roof and extending parallel thereto in the direction of incline and having a wing member fixed to the lower end thereof relative to the roof slope and extending angularly outwardly therefrom away from the base member to prevent movement of snow or ice on the roof piling up behind the wing member. The improvement resides in the formation of the base member and the wing member as an integral element of molded clear plastic to render the snow guard practically invisible when mounted to the roof and to eliminate discoloration of the roof by rendering the snow guard corrosion proof regardless of the extent of weathering of the snow guard.

The base member may particularly take the form of a narrow strip, the wing member may be of butterfly shape in the form of two edge merged discs extending to each side of the base member, with the snow guard further comprising integral reinforcing fillets as laterally spaced walls which join the outer face of the base member with the upper face of the wing member.

Preferably, the base member comprises a plurality of longitudinally spaced holes for permitting the base member to be mounted to the roof and each of said discs is provided with a large circular hole in the center thereof and a plurality of circumferentially spaced smaller holes as an array about the larger hole with the periphery of the discs being beveled radially outward from their lower face towards the upper face.

DESCRIPTION OF THE PREFERRED EMBODIMENT

Figure 1:
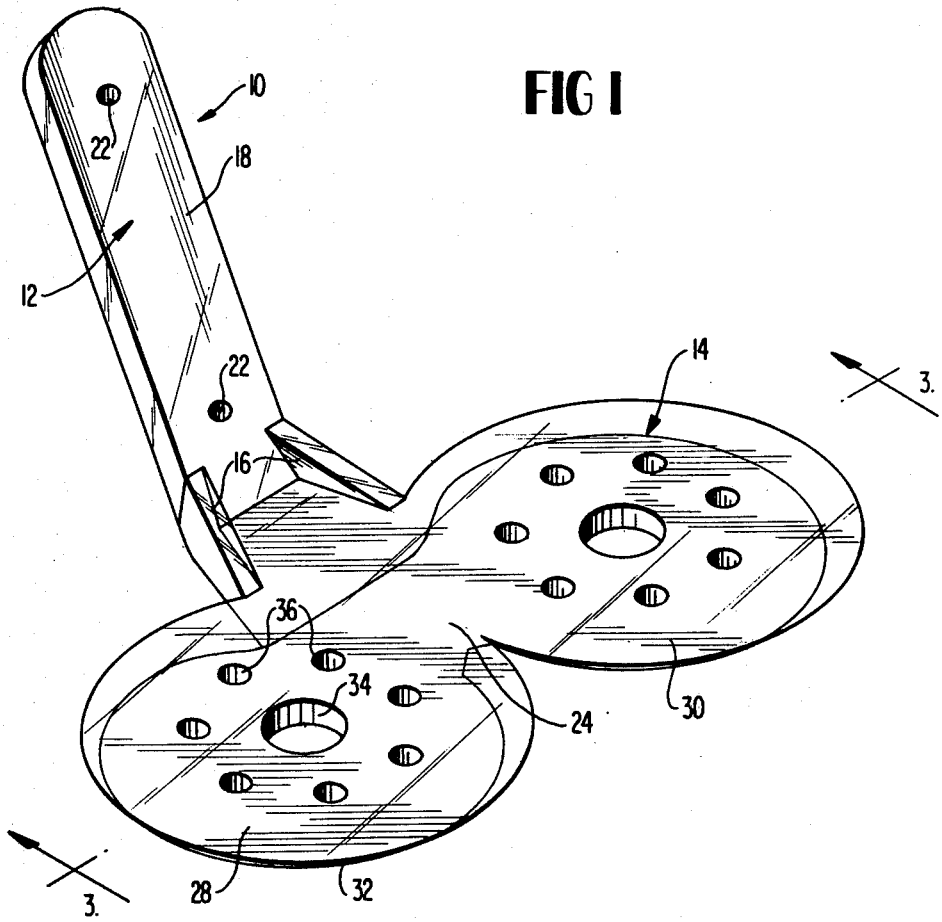
FIG. 1 is a perspective view of the improved roof snow guard of the present invention.
Figure 2:
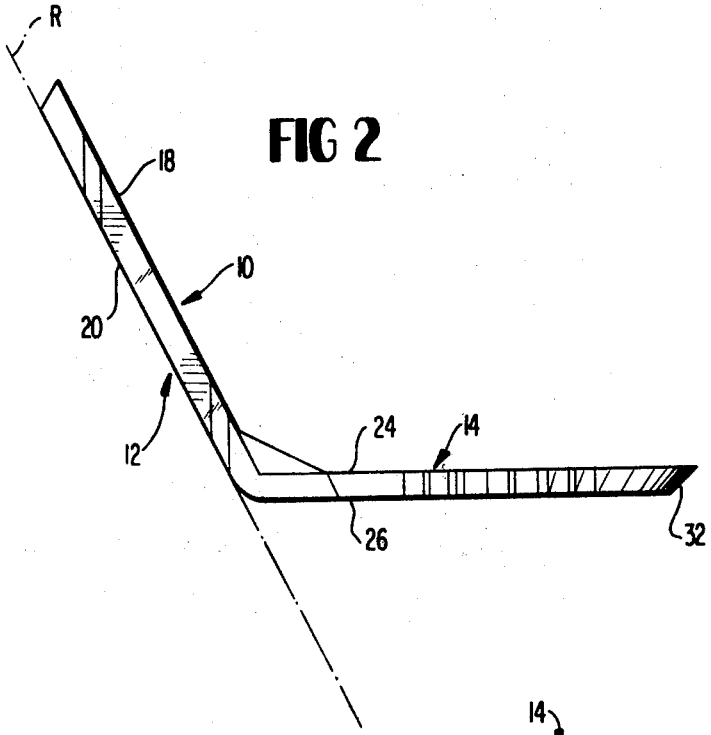
FIG. 2 is a side view of the snow guard of FIG. 1.
Figure 3:
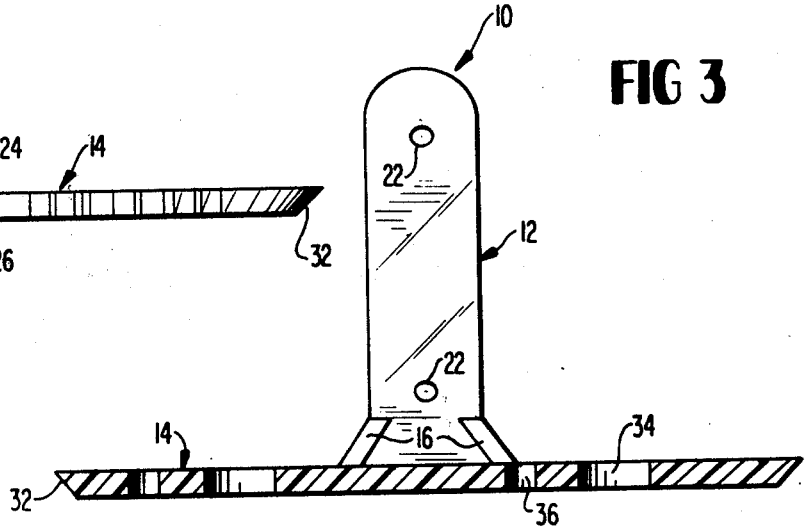
FIG. 3 is a plan view of the snow guard in the plane of mounting.

Referring to the drawings, the figures disclose a preferred embodiment of the present invention in which the snow guard, indicated generally at 10, is constituted by a base member or portion 12 which is integral with a wing member or portion indicated generally at 14. Preferably, the snow guard 10 is injection molded of a clear plastic such as LUCITE, a registered trademark of Du Pont De Nemours Corporation, the LUCITE clear plastic material being corrosion proof with respect to the outdoor ambience, being essentially transparent and having the capability of withstanding high summer temperatures and low winter temperatures without deterioration or cracking. The base member 12 takes the form of a narrow strip having an outer surface 18 and an inner surface 20 with respect to the roof R, FIG. 2, when mounted thereon, the base member being elongated such that its longitudinal axis parallels the direction of slope of the roof. The wing member or portion 14 is joined to the base member or portion 12 at the lower end of the base member, and this is facilitated by means of fillets 16 taking the form of laterally spaced reinforcing walls. In that respect, the wing member 14 is comprised of two edge merged discs 28 and 30, each having an upper surface 24 and a lower surface 26 relative to the slope of the roof, the reinforcing walls or fillets 16 extending from the outer surface 18 of base member 10 to the upper surface 24 of the wing member 14. The two discs 28 and 30, being joined at a point corresponding to the center line of the base member 10, provide the wing member with a butterfly configuration which may be easily seen in FIG. 1.

Further, to permit the seepage of moisture during melting of the accumulated ice or snow and to resist the effect of wind acting upon the wing member which projects outwardly from the roof R and the integral base member 10, a series of perforations are provided within each of the discs. Each disc includes a relatively large diameter center opening or hole 34, and a plurality of smaller diameter holes or openings 36 are provided at spaced circumferential positions surrounding the larger hole 34 for each disc. Preferably, the periphery 32 of each of the discs 28 and 30 is beveled outwardly in a direction from the bottom or lower surface of the wing member 14 towards the upper surface 24.

The operation and use of the improved snow guard is identical to that of the conventional opaque cast iron or aluminum elements of the prior art. However, as may be appreciated by reference to the figures, by forming the element of clear plastic, it becomes essentially invisible. At the same time, particularly where the element is injection molded with a unitary and integral base and wing portion, the cost is low and the reinforcing fillets or walls 16 provide sufficient strength to the unit to resist breakage under heavy snow and ice and wind accumulated loads. Since the element is formed of clear plastic, it is corrosion and weather proof, eliminating the staining of that portion of the roof lying beneath the snow guard.

While the invention has been particularly shown and described with reference to a preferred embodiment thereof, it will be understood by those skilled in the art that various changes in form and details may be made therein without departing from the spirit and scope of the invention.

What is claimed is:

1. In a roof snow guard of the type comprising a base member for mounting flush with an inclined building roof and extending parallel thereto in the direction of incline and having a wing member fixed to the lower end thereof relative to the inclination of the roof and extending angularly outwardly therefrom away from the base member and acting to prevent movement of snow or ice piling up on the roof behind the wing member, the improvement wherein: said base member and said wing member comprise an integrally molded clear plastic element to render the snow guard practically invisible on the roof and to prevent discoloration of the roof during weathering of the snow guard.

2. The roof snow guard as claimed in claim 1, wherein said base member takes the form of a narrow elongated strip, and said at least one wing member is of butterfly shape in the form of two edge merged discs extending outwardly of a common center line with that of said base member, and said guard further comprises integral fillets in the form of laterally spaced walls along respective edges of said base member and joining the outer face of the base member with the upper face of said at least one wing member.

3. The roof snow guard as claimed in claim 2, further comprising longitudinally spaced holes within said base member for effecting mounting of the base member to said roof, a large circular hole within the center of each of said discs, and a plurality of smaller holes constituting a circumferentially spaced array about the larger hole of each disc, and wherein the peripheries of said discs are beveled radially outwardly from the lower face thereof towards the upper face.

* * * * *